US005288958A

United States Patent [19]

Grunert et al.

[11] Patent Number: 5,288,958

[45] Date of Patent: Feb. 22, 1994

[54] LOCKABLE REMOTE ROTARY HANDLE OPERATOR FOR CIRCUIT BREAKERS

[75] Inventors: Kurt A. Grunert, Beaver; Gerald J. Leary, Franklin Park; Joseph M. Kline, Robinson Township, Allegheny County; Ronald D. Smiddle, Canonsburg, all of Pa.

[73] Assignee: Westinghouse Electric Corp., Pittsburgh, Pa.

[21] Appl. No.: 860,660

[22] Filed: Mar. 30, 1992

[51] Int. Cl.[5] ..... H01H 3/20

[52] U.S. Cl. ..... 200/331; 200/330; 200/329; 200/43.14; 200/43.11

[58] Field of Search ..... 200/331, 329, 330, 332, 200/332.1, 332.3, 333, 335, 336, 337, 338, 318, 321, 322, 43.01, 43.02, 43.04, 43.07, 43.08, 43.11, 43.14, 43.15, 43.16, 43.19, 43.21

[56] References Cited

U.S. PATENT DOCUMENTS

| | | | |
|---|---|---|---|
| 2,237,530 | 4/1941 | Olley | 74/96 |
| 2,258,232 | 10/1941 | Atwood et al. | 200/329 |
| 2,368,083 | 1/1945 | Adam | 200/330 |
| 2,961,501 | 11/1960 | Pitro, Jr. | 200/380 |
| 3,141,933 | 7/1969 | Gautzier | 200/328 |
| 4,328,718 | 5/1982 | Robinson et al. | 74/96 |

*Primary Examiner*—Henry J. Recla
*Assistant Examiner*—David J. Walczak
*Attorney, Agent, or Firm*—Gary R. Jarosik

[57] ABSTRACT

A remotely positioned rotary operator handle for cooperating with a circuit breaker with a linearly movable handle. A housing is mounted over the circuit breaker handle. Within the housing a slide carrying a rack engages the circuit breaker handle which further engages a pinion gear sector mounted on a rotatable shaft. The rotatable shaft extends from the housing and has positioned thereon a motion translating device which translates between rotational motion and linear motion. The rotary handle extends from a housing which is flange mounted on a cabinet in which the circuit breaker is disposed. A corresponding motion translating device is attached to the flange mounted rotary handle which is in turn connected to the motion translating device attached to the rotatable shaft. The connection between the motion translators comprises a linearly moving link. The rotary handle has an extendable hasp which comprises part of the connection between the rotatory handle and the motion translating device. The hasp is provided for allowing the the circuit breaker to be locked in the off position. The hasp has a foot which fixedly engages the rotary handle housing when in the extended position thereby preventing the rotation of the rotary operator handle. The hasp further has an aperture which accepts the shackle of a lock for locking the hasp in the extended position.

19 Claims, 5 Drawing Sheets

LOCKABLE REMOTE ROTARY HANDLE OPERATOR FOR CIRCUIT BREAKERS

CROSS-REFERENCE TO RELATED APPLICATIONS

The subject matter of this application is related to the following copending U.S. patent application:

1. U.S. patent application Ser. No. 729,084 entitled "Lockable Rotary Handle Operator For Circuit Breaker" by K. A. Grunert, R. J. Price, R. A. Cheski, and R. D. Smiddle.

BACKGROUND

This invention relates to handle operators which provide an interface and additional electrical isolation between the handle of a circuit breaker mounted in a cabinet behind a panel door and the person operating the circuit breaker. It also relates to such a handle operator, positioned remotely from the circuit breaker, which converts the rotary motion of the handle operator to the linear motion needed to control the pivot handle of the circuit breaker and which is further lockable in the circuit breaker off position.

A common type of circuit breaker has a pivot handle which moves linearly between an on and an off position. The pivot handle is connected to the movable contacts within the circuit breaker assembly through a spring powered, over center toggle device. When the handle is moved into the on position, the movable contacts close upon themselves creating an electrical connection. When the handle is moved into the off position, the movable contacts separate from each other interrupting the electrical connection. In response to certain overcurrent conditions, the contacts open automatically causing the handle to move to an intermediate position.

In some installations, the circuit breakers are mounted behind a door in a cabinet. Typically in these installations, the pivot handles of the circuit breakers protrude through openings in the door where they are operated directly. This configuration has the disadvantage of leaving the circuit breakers exposed to the environment. In some applications, it is deemed desirable to provide an interface between the handle and the person operating the breaker. This interface often is a flange-mounted, linearly movable, pivot handle operator. Typically, these pivoted handle operators are spring biased, usually in the off position, with the spring serving as the driving connection between the circuit breaker handle and the remote pivot handle operator.

Performance of these interfaces has not always been satisfactory. Typically, they have substantial mass which loads the over center toggle device of the breaker. The spring force of the toggle device is generally weakest at the trip position, and the additional loading imposed by the pivoted handle operator structure has made it difficult to position the handle at the trip position should a trip condition occur. While tripping of the circuit breaker is not adversely affected, accurate positioning of the handle is necessary to provide a visual indication of the tripped condition of the circuit breaker.

Another problem can arise when the known remote handle operator mechanism is locked in the off position. In some instances, this locking can be done even though the contacts within the circuit breaker have become welded closed. While this condition was made possible by the internal structure of some circuit breakers, such breakers have in many instances been modified to prevent even moving the circuit breaker to the off position when the contacts are welded closed. Despite these modifications, the known handle operator mechanisms can still be moved to and locked in the off position providing a false indication of the state of the circuit breaker when the contacts are welded shut. This is owing to the spring connecting the handle operator and the circuit breaker handle.

There exists a need for an improved remote circuit breaker handle operator for use in flange-mounting. It is also desirable to replace the remote, linearly movable, pivot handle operator with a remote, rotatable handle operator. More particularly, a need has been shown for an improved handle operator which does not place a load upon the spring of the toggle device and which further operates without a biasing spring connection. This improved handle operator should have the capability of being locked in the off position without misrepresenting the state of the circuit breaker, should provide the circuit breaker mounted in the cabinet an environment sealed from dust and moisture, should incorporate an interlock for the door of the cabinet in which the circuit breaker is mounted, and should have its coupling free from the problems of sagging, misalignment, and preventing proper door closure.

SUMMARY OF THE INVENTION

These needs have been satisfied by the invention which is directed to a remote rotary handle operator used in conjunction with a circuit breaker with a linearly movable pivot handle.

The rotary handle operator includes a housing which is mounted on the front of the circuit breaker over its linearly movable, pivoting handle. Within the housing, a slide member having an incorporated rack engages the handle of the circuit breaker and is movable along the same linear path. A rotating member comprised of a pinion gear section is also mounted within the housing for rotational movement and is connected to the slide member by engaging its rack. A shaft is then connected to the rotating member, such that the linear motion of the circuit breaker handle (when the circuit breaker trips) produces a corresponding rotational movement in the shaft. Likewise, the rotational motion of the shaft produces a corresponding linear motion capable of moving the circuit breaker handle.

The circuit breaker is linked to a remote, rotary handle operator which is flange-mounted in the cabinet in which the circuit breaker is disposed. The link is comprised of two bi-directional, rotational to linear translating devices, one disposed upon each of the housing shaft and the remote rotary handle operator. These translating devices are connected together by width adjusting rods allowing for the variable positioning of the rotary handle operator with respect to the circuit breaker. The use of spring connectors has been eliminated. Furthermore, the connection between the translating device and the housing shaft is supported by a support assembly. This support assembly eliminates misalignment, prevents impacts from impinging on the rotary housing, and allows for variable depth adjusting. Finally, the handle operator is equipped with a pullout hasp. This hasp has an aperture for accepting the shackle of a lock when the hasp is drawn out in its extended position. When the hasp is locked in this extended position, the rotational capability of the rotary handle operator is interfered with. This mechanism locks the rotating handle operator in the circuit breaker off position. The rotary handle operator includes an interlock which must be activated to open the cabinet door behind which the circuit breaker is mounted. The rotary handle operator can be constructed of both die cast and plastic materials for industrial and chemical environments and is further constructed to be water resistant for use under marine and humid conditions.

BRIEF DESCRIPTION OF THE DRAWINGS

A full understanding of the invention can be gained from the following description of the preferred embodiment when read in conjunction with the accompanying drawings in which.

DETAILED DESCRIPTION OF THE DRAWINGS

While the invention can be used for connecting circuit breakers to remote rotary handle operators in a variety of circuit breaker cabinets, the invention will be described hereinafter in the context of a flange-mounted, remote, rotary handle operator as the preferred embodiment thereof.

Figure 1:
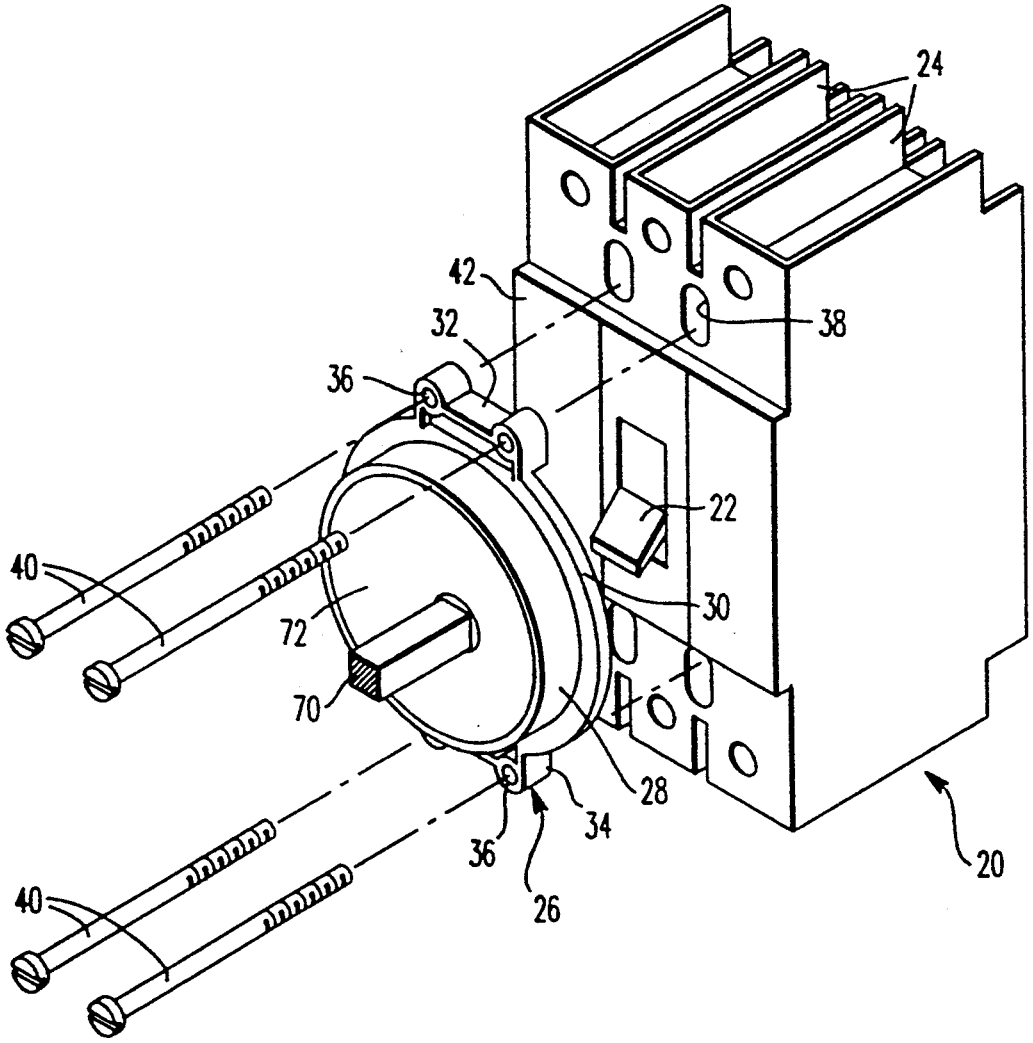
FIG. 1 shows an isometric view of the rotary handle linear to rotary bi-directional motion translating house in position to be mounted upon a circuit breaker.

Referring to FIG. 1, the invention is applied to a molded case circuit breaker 20. While the exemplary circuit breaker 20 is a three phase breaker, the invention is applicable to any breaker having a linearly movable, pivot handle 22. As the handle 22 is moved into the raised or on position, the internal mechanism of the breaker 20 closes the internal electrical contacts of the breaker completing the circuit between the three phase line terminals 24 located on the exemplary breaker and the three phase load terminals similarly located on the opposite side of the breaker. As the handle 22 is moved into the lowered or off position, the internal electrical contacts of the breaker 20 separate interrupting the circuit between the line terminals 24 and the load terminals. Under certain current overload conditions, the circuit breaker 20 trips causing the internal contacts to separate. During this trip condition, the handle 22 of the breaker 20 is moved from the raised on position to an intermediate position between the raised on position and the lowered off position. To reset the tripped breaker, the handle 22 is pressed below the lowered off position. The handle 22 can then be returned to the raised on position to reclose the contacts.

The circuit breaker 20 has disposed over the handle 22 the bi-directional motion translating house 26, the subject matter of which is disclosed in the copending U.S. patent application Ser. No. 729,084 entitled "Lockable Rotary Handle Operator For Circuit Breaker" having the same assignee as the present application. The motion translating house 26 translates between the linear motion of the circuit breaker pivot handle 22 and the rotational motion utilized by the linking mechanism discussed hereinafter. The housing 26 can be seen in FIGS. 1 through 4 and in FIG. 7. Returning to FIG. 1, the housing 26 is comprised of a molded cylindrical base 28 having an annular flange 30 on one side. Extending from the flange 30 are the radial mounting flanges 32 and 34 located on opposite sides of the base 28. The flanges 32 and 34 are each constructed with a pair of mounting holes 36 that align with the preformed holes 38 in the circuit breaker 20 when the housing 26 is disposed thereon over the handle 22. The four mounting bolts 40 pass through this alignment of holes, 36 and 38, operating to secure the housing 26 to the breaker 20. The flanges 32 and 34 are further constructed to extend axially beyond the radial flange 30 thereby creating a transverse slot between the two. When the housing 26 is mounted on the breaker 20 centered over the handle 22, the transverse slot created by the outwardly extending flanges 32 and 34 accommodates the raised horizontal center section 42 found on circuit breaker 20. The covering of the handle 22 by the housing 26 further functions to protect the internal mechanisms of the breaker 20 from exposure to industrial and chemical environments.

Figure 2:
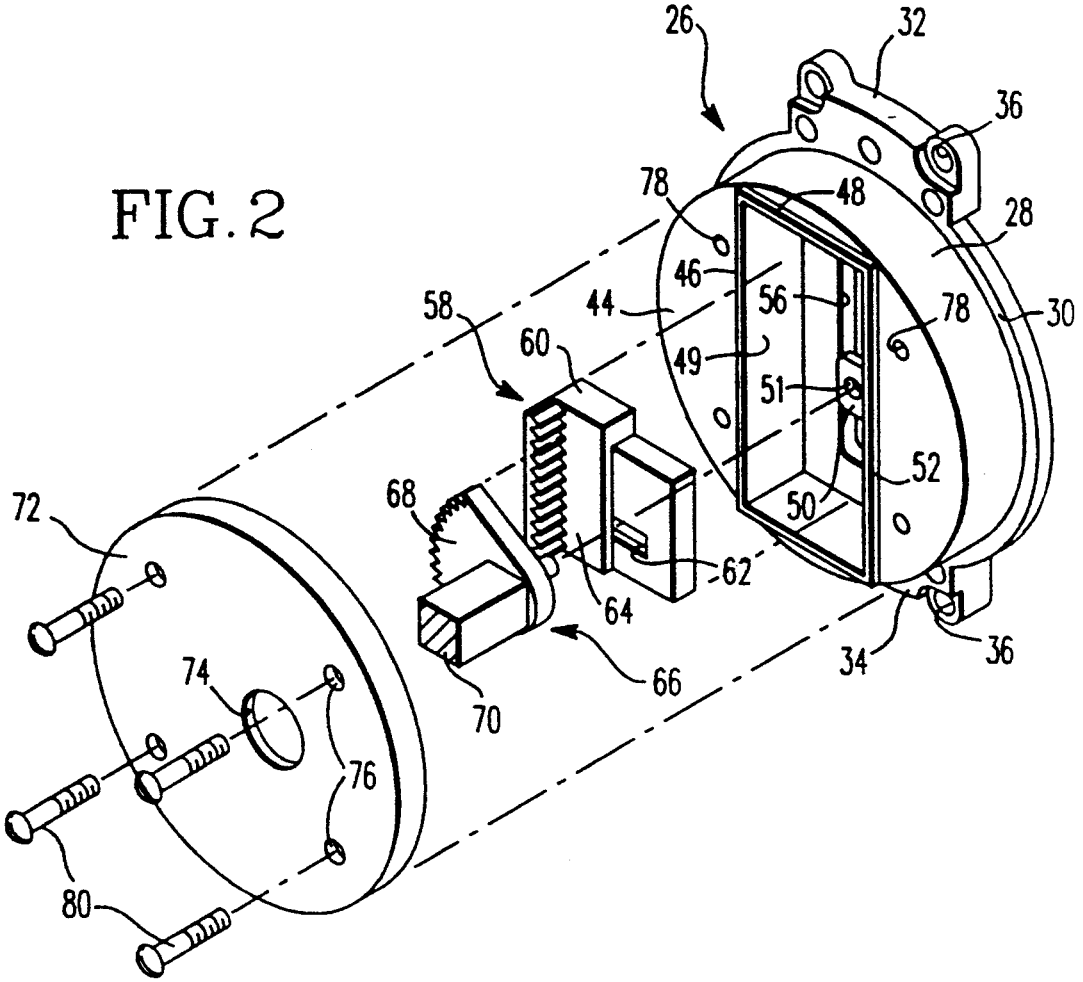
FIG. 2 shows an exploded isometric view of the motion translating house of FIG. 1.
Figure 3:
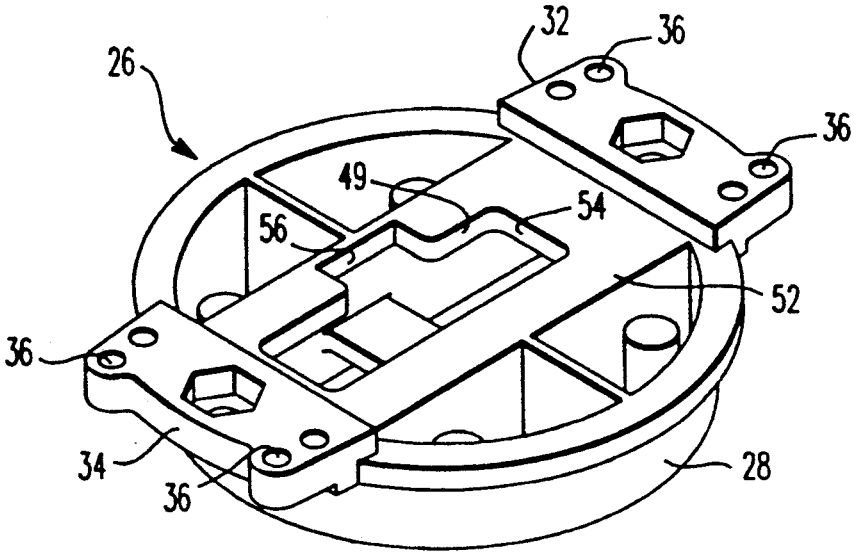
FIG. 3 shows an isometric view of the undercarriage of the motion translating house of FIGS. 1 and 2.

Turning now to FIG. 2, the housing base 28 is constructed with a circular wall 44 opposite the flange 30. This wall 44, and the two opposing, axially extending, internal chordal walls 46 and 48 form a generally rectangularly shaped chamber 49 inside the housing 26. The chordal wall 46 is constructed with a flange 50 laterally projecting into the chamber 49 located approximately midway along the length and height of the chamber 49. This flange 50 has molded into it a hole 51. FIG. 3 shows chamber 49 being partially closed by wall 52 leaving an elongated opening 54. This opening 54 has a transverse extension 56 that is aligned over the location of the projecting flange within chamber 49 for allowing the molding of the projecting flange during the construction of the base 28. The opening 54 accommodates the handle of the circuit breaker allowing for its complete freedom of movement when the housing 26 is disposed thereon.

Turning back to FIG. 2, the chamber 49 is created to accept the slide member 58. The slide member 58 is generally rectangular in shape and is comprised of a base section 60 having therein a transverse slot 62 and a raised rack portion 64 supported by the base 60 and extending along the side thereof. As slide member 58 is disposed within the chamber 49 it rests upon the wall 52 under the flange 50 with its rack 64 positioned opposite flange 50 and is slidable longitudinally within the chamber 49. When the housing 26 is disposed upon the circuit breaker over the circuit breaker handle, the circuit breaker handle becomes engaged within the transverse slot 62 in the slide member 58. The construction of the housing 26 and the length of the chamber 49 allow the circuit breaker handle to continue to operate through its full extent of motion.

Engaging the slide member 58 within the chamber 49 is the rotating member 66 comprised of a pinion gear section 68 having a concentrically mounted square shaft 70. On the side opposite the square shaft 70, the pinion gear section 68 has a concentrically mounted pivot pin which is rotatably received in the hole 51 in the flange 50. When the rotating member 66 is disposed upon the flange 50 within the chamber 49, the pinion gear section 68 engages the rack portion 64 of the slide member 58. Once the slide member 58 and the rotating member 66 are disposed within the chamber 49 within the housing 26, the cover 72 is secured atop the base 28. The cover 72 has a centrally located aperture 74 through which the square shaft 70 of the rotating member 66 protrudes when the cover 74 is secured to the base 28. The cover 72 further has four screw holes 76 which align with the four transversely threaded holes 78 located in the wall 44 of the base 28. Into these four aligned holes are placed the four securing screws 80 which lock the cover 72 upon the base 28.

Figure 4:
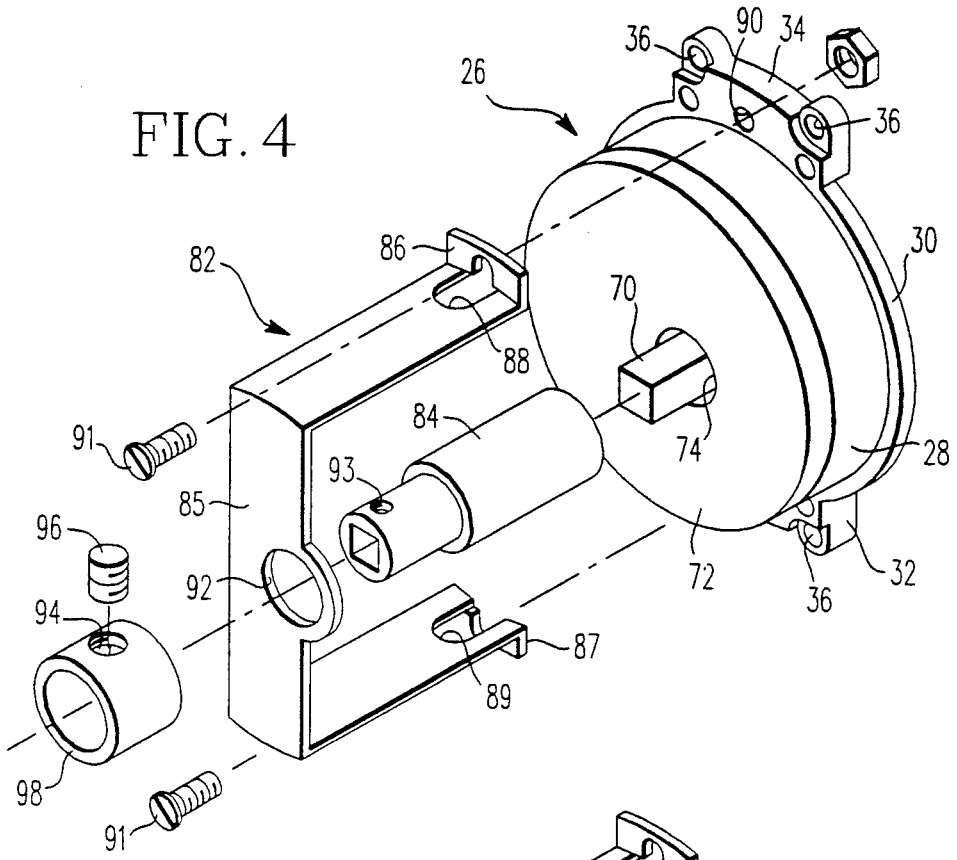
FIG. 4 shows an isometric view of the support bracket assembly to be connected to the motion translating house of FIGS. 1 through 3.

Turning now to FIG. 4, the assembled housing 26 is shown with the square shaft 70 protruding through the aperture 74 in the cover 72. Before the housing 26 is disposed upon the circuit breaker, the handle shaft support assembly 82 is disposed upon the housing 26. Atop the square shaft 70 is non-rotatably telescoped the cylindrical coupling 84. The coupling 84 is constructed with a squared interior for accepting the squared shaft 70. Further attached to the housing 26 is the u shaped support bracket 85. The bracket 85 has two flanges 86 and 87 located at either end of the u shape which further have two apertures 88 and 89. These apertures, 88 and 89, align with the two apertures 90 located, one apiece, on the axial flanges 32 and 34 and through which the screws 91 pass locking the bracket 85 to the housing 26. The bracket 85 further has a centrally located aperture 92 through which the coupling 84 passes. The coupling 84 is constructed with two differing exterior diameters, with the larger diameter running the length of the coupling 84 up to the point where the coupling 84 is to pass through the aperture 92 in the bracket 85. The aperture 92 in the bracket 85 matches the smaller diameter of the coupling 84 thereby causing the coupling 84 to be secured on the shaft 70 by being pinched between the bracket 85 and the housing 26. The smaller diametered portion of the coupling 84, which extends beyond the bracket 85, has a transversal aperture 93 for accepting a set screw 96. The set screw 96 is also used to secure a collar 98, through aperture 94, upon the coupling 84 after the linking mechanism, to be discussed hereinafter, has been connected to the handle shaft support assembly 82. The coupling 84 is constructed from synthetic material which allows for minimum torque to be applied to the set screw 96, any torque exceeding the minimum required torque would tend to strip the threads in the plastic material from which the coupling 84 is constructed. Since the coupling 84 is secured in compression, exceeding the required torque is not necessary.

Figure 5:
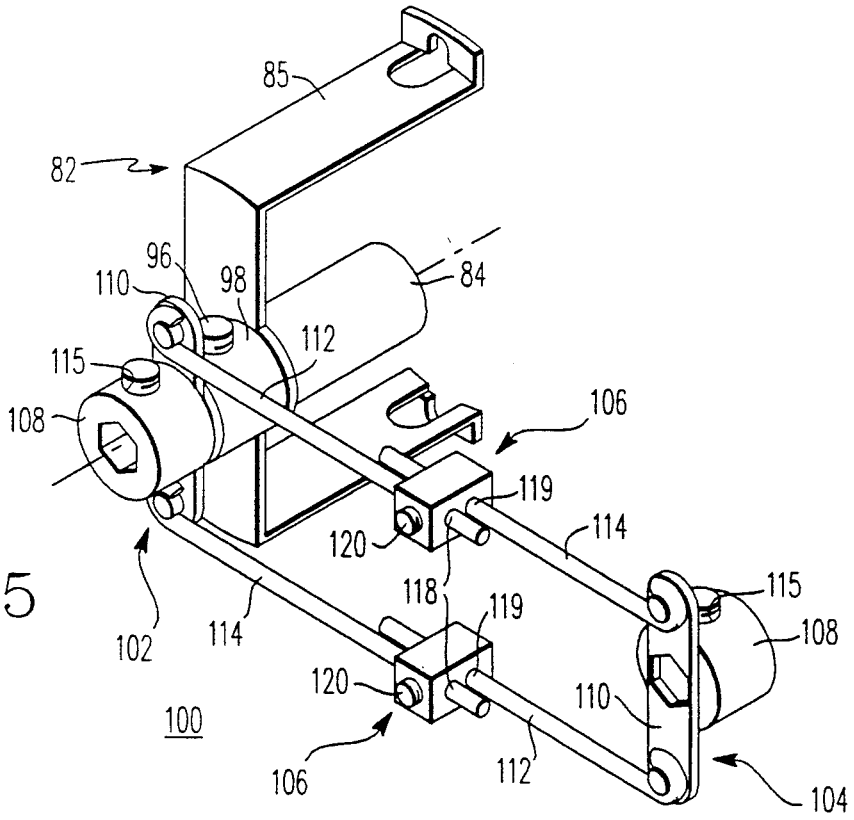
FIG. 5 shows an isometric view of the two bi-directional motion translating links mounted upon the support bracket assembly of FIG. 4.

Turning to FIG. 5, the linking mechanism 100 is disposed upon the handle shaft support assembly 82. The linking mechanism 100 is comprised of two bi-directional motion translating devices 102 and 104 and two rail links 106 between the two. The two motion translators are constructed identically and comprise a cylindrical sleeve 108 having a squared interior. The cylindrical sleeve 108 has axially attached to one end the flange 110. The flange 110 is non-rotatably mounted on sleeve 108 with the ends of the flange 110 extending radially outward in both vertical directions. Rotatably attached to one vertical portion of the flange 110 is the rail 112, while rotatably attached to the other vertical portion of the flange 110 is the rail 114. Furthermore, the cylindrical sleeve 108 has a transversal aperture 115 for accepting a set screw.

Translating device 102 is mounted upon the handle shaft support assembly 82, and more specifically is non-rotatably attached to the coupling 84 of the support assembly. A square peg is inserted into the cylindrical sleeve 108 where the sleeve 108 is adjoined by flange 110 and is locked into position through the use of a set screw applied through aperture 115. The non-attached portion of the square peg is inserted through the collar 98 displaced upon the coupling 84 and into the squared interior of the coupling 84 itself. The square peg and the attached translating device 102 are secured to the coupling 84 when the set screw 96 is tightened within collar 98 and coupling 84.

The two motion translating devices 102 and 104 are connected by securing together the rail 112 of one device to the rail 114 of the opposite device. The rails are connected through the use of the rail link 106. The rail link 106 is a rectangular solid having two transversal apertures 118 and 119 extending in parallel along its width. Each aperture 118 and 119 has a transversely threaded aperture 120 that is perpendicularly connected thereto, these apertures 120 for accepting locking screws. Into aperture 118 is disposed a rail, either 114 or 112, and into aperture 119 the corresponding other rail from the other translating device is inserted. These rails are then secured in place by tightening the locking screws located in the apertures 120. The rail link 106 allows the rails to be positioned in varying relation with one another thus allowing the motion translating devices themselves to be positioned at varying relative distances.

Figure 6:
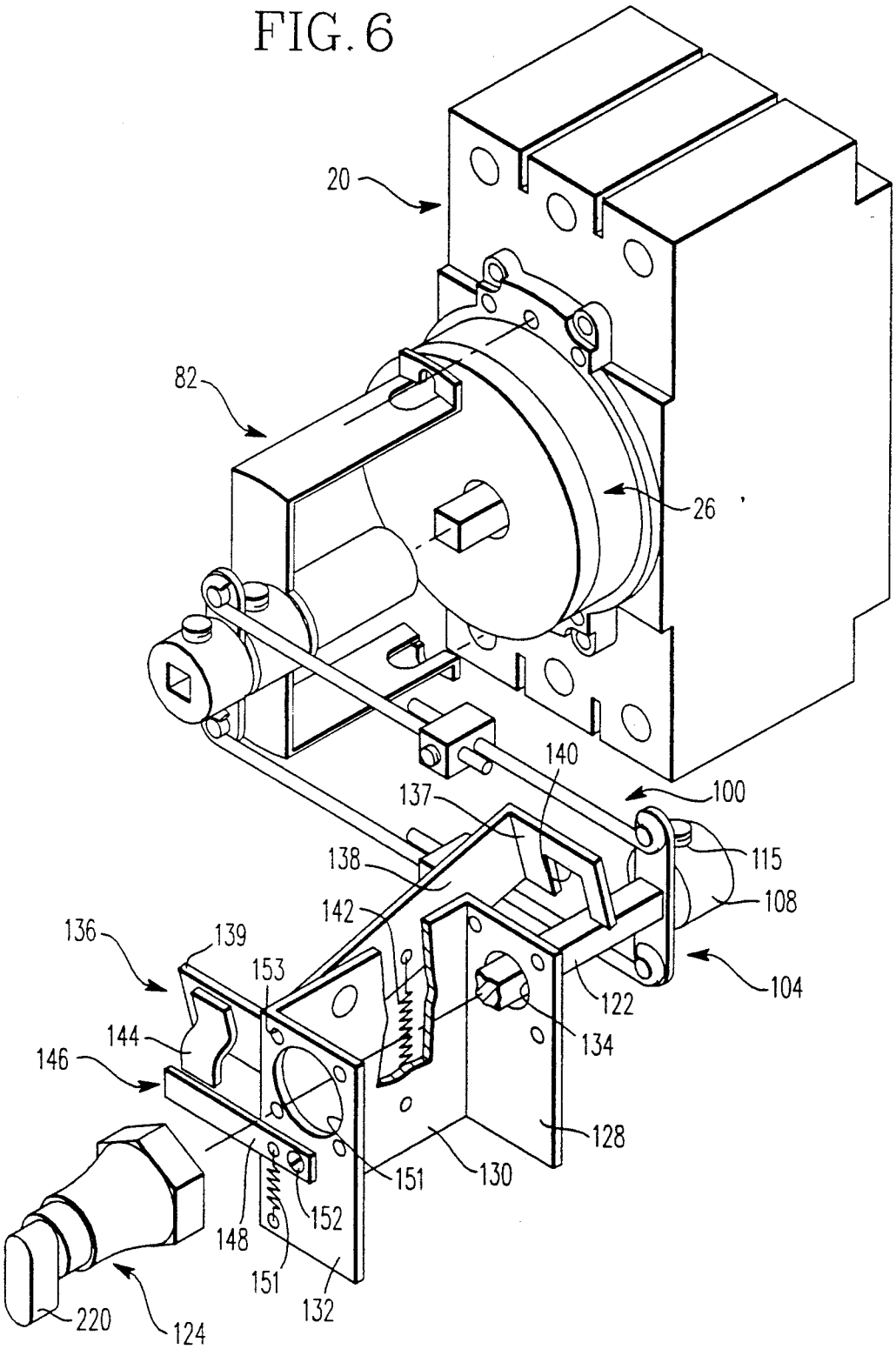
FIG. 6 shows an isometric view of the remote handle assembly, the bi-directional motion translating links of FIG. 5, the support bracket assembly of FIG. 4, and the housing of FIGS. 1 through 3, prepared to be mounted upon the circuit breaker.

Turning now to FIG. 6, shown is the linking mechanism 100 disposed upon the support assembly 82 and ready to be mounted upon the rotational housing 26 which in turn is in position to be mounted on the circuit breaker 20. Referring specifically to the translating device 104 of the linking mechanism 100, shown disposed within the square interior of the sleeve 108 is the square handle operator shaft 122 which is locked into place by a set screw applied in aperture 115. Upon the opposite end of the handle operator shaft 122 is disposed the remote rotary operator handle 124 to be discussed further hereinafter. Further shown in FIG. 6 is the mounting portion of the flanged cabinet 126 having a shaft support wall 128, a lock support wall 130, and a handle support wall 132. The shaft support wall 128 has a circular aperture 134 through which the square handle operator shaft 122 is passed and supported. The lock support wall 130 has pivotally attached thereto the cover lock mechanism 136. The cover lock mechanism 136 prevents the user from controlling the circuit breaker 20 when the door of the cabinet is opened. It is constructed in a z-shape with one leg 137 extending parallel behind the shaft support wall 128, with one leg 138 extending parallel along the lock support wall 130 (to which it is pivotally attached), and with one leg 139 extending parallel along the face of the door of the cabinet in which the assembly is placed. The leg 137 has a square notch 140 into which the square handle operator shaft 122 can be disposed. The leg 138 has a spring 142 attaching it to the support wall 130 opposite the pivot which tends to raise leg 139 while lowering leg 137 upon the square shaft 122. The leg 139 has rigidly attached thereto a longitudinally extending flange 144. The portion of flange 144 opposite the portion adjoining leg 139 is curved slightly inward toward the cabinet door. When the cabinet door is in the closed position, flange 144 is depressed downward, pushing leg 139 downward raising leg 137 on the opposite end of the pivot against the action of the spring 14 thereby freeing the shaft 122 from the notch 140. When the door is opened, the pressure is withdrawn from the flange 144 allowing the spring 142 to lower the square notch 140 in leg 137 upon the square shaft 122 thereby preventing its rotation.

FIG. 6 also shows the door lock mechanism 146 which prevents the unwanted opening of the cabinet door. The door lock mechanism is constructed with a flange 148 extending parallelly along wall 132 and rotatably connected thereto. Further connecting the flange 148 to the wall 132 is the biasing spring 150 which tends to pull the flange 148 into the horizontal position. The flange 148 extends beyond the wall 132 where it can be engaged by a hooked flange positioned perpendicularly upon the cabinet door. When the door is in the closed position the hooked door flange is engaged by the lock flange 148 thereby preventing the door from opening. To disengage the lock flange 148 from the hooked door flange for opening the door, the screw 152 non-rotatably attached to the flange 148 over its pivotal mount can be turned to raise the flange 148 thereby causing the flange 148 to be cleared of the hook of the door flange.

Figure 7:
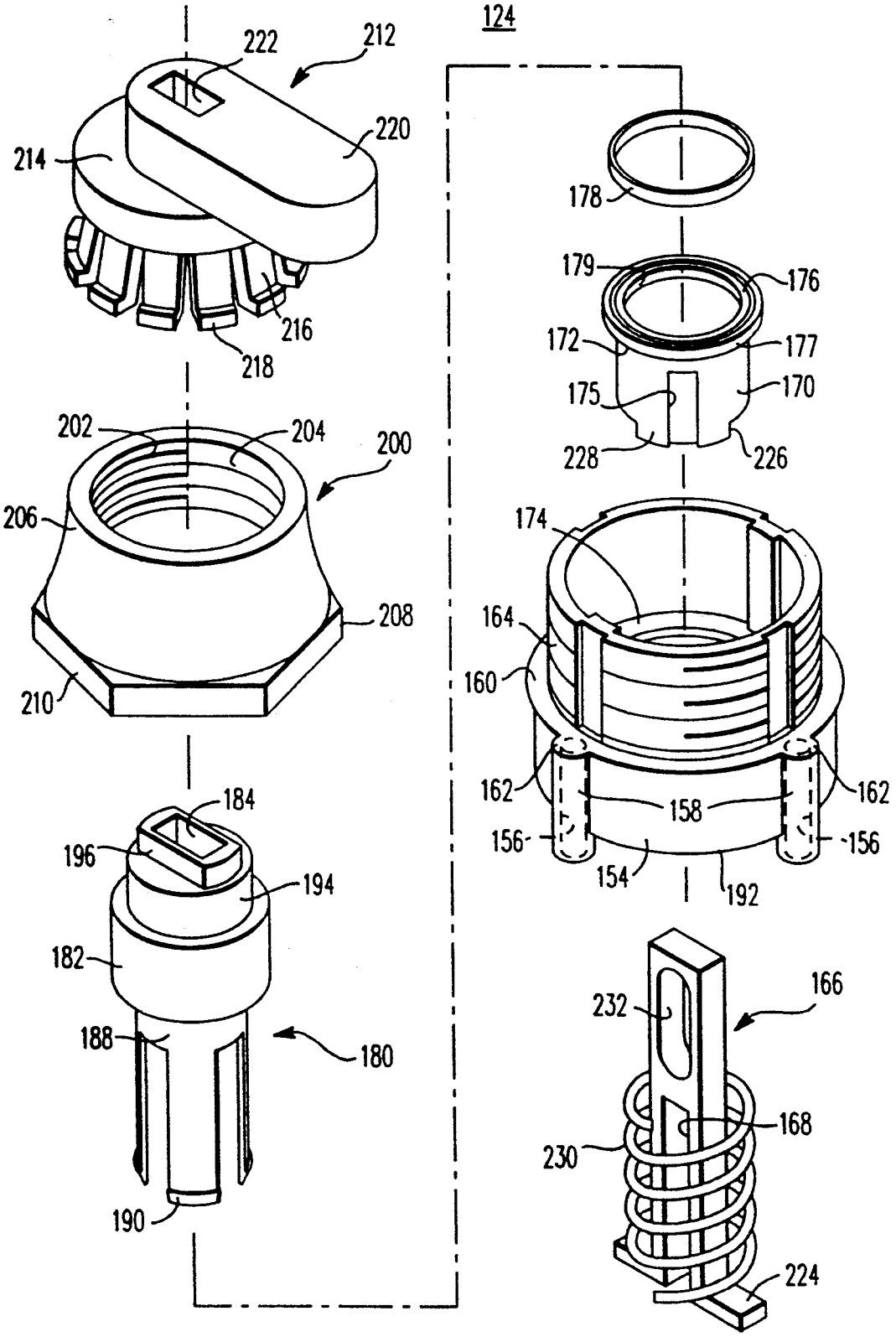
FIG. 7 shows an exploded isometric view of the remote handle assembly of FIG. 6.

The handle assembly 124 which is attached to shaft 122 is mounted upon the handle support wall 132 over the hole 151 through the use of bolts passing through the mounting holes 153. Turning specifically to FIG. 7, the handle assembly 124 is encased within the molded cylindrical housing 154. It is this housing 154 which is mounted to the handle support wall by passing mounting bolts through the holes 156 in the support legs 158 attached to the outside of housing 154 before passing the bolts through the mounting holes in the handle support wall. Specifically, cylindrical housing 154 is constructed with an annular flange 160 located around its midsection, this flange 160 has semicircular protrusions 162 that cover the molded circular support legs 158 located on the lower half of housing 154 through which the mounting holes 156 pass. The upper half of the housing has molded into its outer shell a thread 164.

Passing into the housing 154 is the squared handle shaft which joins with rectangular hasp 166. The hasp 166 is mounted on the squared handle by inserting the shaft into the squared notch 168 cut into the lower portion of the hasp 166. After the hasp 166 is connected to the handle shaft within the housing 154, the circular sleeve 170 is placed in the housing 154. The circular sleeve 170 has a molded annular lip 172, created by the upper portion of the sleeve 170 having a larger circumference than the lower section of the sleeve 170, such that lip 172 rests upon the annular flange 174 molded into the interior wall of the housing 154. Furthermore, sleeve 172 has a molded notch 175 that engages a protrusion molded within housing 154 that causes sleeve 170 to become non-rotatably engaged within the housing 154. An interiorly extending annular flange 176 is molded just below the upper rim 177 of the housing 170 and is used to support a sponge gasket or a spring gasket 178.

The handle shaft and mounted hasp 166 combination extends through the aperture 179 in the sleeve 170 and has the rotary drive 180 further mounted thereon. The rotary drive 180 has a cylindrical base member 182, having a centrally positioned rectangularly notched aperture 184 into which the hasp 166 is accepted. As the rotary drive 180 is mounted, it fits into the upper portion of the housing 154 and rests upon the upper rim 177 of the sleeve 170 already inserted into the housing 154 thereby trapping the sponge gasket or the spring gasket 178 on the annular flange 176. Connected to the bottom of the base member 182 are the snap fingers 188 such that when the rotary drive 180 is inserted into the housing 154 over the hasp 166 the snap fingers 188 are caused to be pushed outwardly because the opening between the snap fingers 188 is smaller than the size needed to accommodate the hasp 166 as the hasp 166 is fitted into the rectangularly notched aperture 184 in the base 182. The snap fingers 188 have at their ends molded lips 190 such that when the rotary drive 180 is finally positioned in the housing 154 atop the hasp 166, the lips 190 engage the bottom rim 192 of the housing 154 owing to the outward pressure being asserted on the snap fingers 188 by the inserted hasp 166. This secures the rotary drive 180 within the housing 154 and once inserted in the housing 154, the rotary drive 180 continues to have freedom of movement in the rotational direction. Atop the cylindrical base 180 is concentrically positioned a circular support base 194 through which the rectangularly notched aperture 184 continues and centrally placed atop the support base 194 is the oblong handle tab 196 through which the rectangularly notched aperture 184 emerges.

Once the hasp 166, the sleeve 170, the gasket 178, and the rotary drive 180 are in place within the housing 154, the clamp ring 200 is screwed onto the housing 154 by mating the threads 164 on the housing 154 to corresponding threads 202 in the circular aperture 204 of the clamp ring top 206. The base 208 of the clamp ring 200 joins the top 206 and widens outwards to form an octagonal end portion 210 which can be used as a means to grip the clamp ring 200 for tightening upon the housing 154. When the clamp ring 200 is tightened upon the housing 154 the base 208 rests upon the flange 160 sealing the assembly.

Disposed upon the rotary drive handle tab 196 which extends through the opening 204 in the clamp collar 200 is the handle 212. The handle 212 has a circular base 214 which has snap fingers 216 protruding from its undercarriage, these snap fingers 216 have lips 218 that become lodged in the offset created by the base 208 as it widens away from the top 206 inside the clamp ring 200 rotatably locking the handle 212 in position upon the assembly. Radially mounted upon the base 214 is the shaft 220 such that one end of the shaft 220 is mounted over the center of the base 214 while the other end of the shaft 220 extends beyond the circumference of the housing 154. The base 214 further has a centered oblong hole extending through it (not visible) into which the oblong handle tab 196 is inserted for rotatably connecting the handle 212 and the rotary drive 180. The shaft 212 covers the oblong hole where it is mounted on base 214, however, the shaft 212 has a rectangular aperture 222 that aligns with the aperture 184 of the oblong handle tab 196 of the rotary drive 180.

The hasp 166 is extendable through the aperture 184 in the rotary drive 180 and the aperture 222 in the handle 212. As the hasp 166 is extended through the aperture 222, the feet 224 located at the end of the hasp 166 engage the lip 226 formed at the base of the sleeve 170 where the flange 228 downwardly extends such that the hasp 166, the mounted rotary drive 180, and the mounted handle 222 are no longer rotatable. The flange 228 is positioned on the sleeve 170 such that the handle assembly 124 can be placed in the locked position only when circuit breaker is in the off position. The hasp 166 further has the compression spring 230 that will cause the hasp 166 to recede as the spring 230 expands when the expanding force is no longer applied withdrawing the hasp 166. The hasp 166 has a lock slot 232 for accepting the hasp of a padlock when the hasp 166 is extended through the aperture 222 for preventing the hasp 166 from retracting within the handle assembly 124 while continually locking the handle assembly 124 in the off position.

When the handle 220 is rotated the handle shaft 122 is caused to rotate due to its connection with the handle 220 through the hasp 166 and the rotary drive 180. As the handle shaft 122 rotates, the flange 110 of translator 104 is caused to rotate about the axis to which it joins the shaft 122. Depending upon the direction handle 220 is turned the flange 110 moves in either a clockwise or counter-clockwise direction. When the flange 110 moves in a clockwise direction, its rod 112 moves towards the translator 102 while its rod 114 moves away from translator 102. This movement of the rods 102 cause the rods of the motion translator 102 to follow owing to their connection through the links 106. The motion translator 102 thus moves in a clockwise direction following the translator 104 as the rod 112 of the translator 102 moves towards translator 104 while the rod 114 moves away from the translator 104. The clockwise motion of translator 102 is followed by shaft 70 to which it is connected to by sleeve 84. As shaft 70 is turned, the pinion gear section 68 follows in the clockwise direction causing sleeve 58 to move linearly upward. The handle 22 of the circuit breaker engaged within sleeve 58 likewise is drawn upward causing the circuit breaker 20 to have its contacts placed in the on position. Likewise, when the handle 220 is rotated in the counter-clockwise direction the handle 22 of the circuit breaker 20 moves into the circuit breaker off position. Similarly, when the breaker 20 experiences a trip condition, handle 22 is caused to move to an intermediate trip position from it on position. This motion is translated to the remote handle 220 through the shaft 70, the translators 102 and 104, and the shaft 122 to which the handle 220 is connected.

It should be apparent from the preceding description of the preferred embodiment that this invention has among other advantages the advantages of allowing a rotating operator handle to be position remotely from a circuit breaker through flange mounting, having the capability of being locked in the circuit breaker off position, providing the circuit breaker mounted in the cabinet an environment sealed from dust and moisture, having an interlock for preventing the unwanted opening of the panel door in which the circuit breaker is mounted, and providing a coupling between the remotely positioned operator handle and the circuit breaker which is free from sagging and misalignment.

It is to be understood that the descriptions and drawings shown with respect to the present invention are not limiting and that other methods of linking a remotely positioned rotary operator handle and a circuit breaker with a linearly moveable switch handle are contemplated.

We claim:

1. In combination, a circuit breaker and a remote rotary operator handle assembly, said circuit breaker comprising:

an electrically insulating housing having a switch handle, said switch handle linearly movable between a circuit breaker on position and a circuit breaker off position; and said remote rotary handle assembly comprising:

a housing assembly mounted on said circuit breaker having a rotatable housing shaft, rotatable around a housing shaft axis, and further having a motion translating means connected to said housing shaft and engaging said switch handle for translating between the linear motion of said switch handle and the rotational motion of said housing shaft;

a rotary operator handle having a rotatable handle shaft, rotatable about a handle shaft axis, for cooperating with said switch handle whereby the movement of one produces a corresponding movement of the other and wherein said handle shaft axis is substantially parallelly aligned relative to said housing shaft axis; and linking means connecting said housing shaft to said handle shaft for transferring between said shafts said respective parallel rotational movements.

2. The combination as recited in claim 1, wherein said motion translating means comprises a slide member engaging said switch handle and mounted in said housing for reciprocal movement with said switch handle along said linear path, and housing shaft connecting means for connecting said slide member to said housing shaft so that movement of one produces a corresponding movement of the other.

3. The combination as recited in claim 2, wherein said housing shaft connecting means comprises said slide member having a rack and said housing shaft means having a pinion gear means nearly centrally mounted thereon and engaging said rack.

4. The combination as recited in claim 3, wherein said linking means comprises a pair of bi-directional rotational to linear motion translators, said motion translators being fixedly attached one to each of said housing and handle shafts, and linearly moving connecting means attached to each of said motion translators for connecting said motion translators and for transferring the respective rotational movement between said motion translators.

5. The combination as recited in claim 4, wherein said linearly moving connecting means further has an adjusting means disposed between said motion translators for allowing said motion translators to be positioned at varying distances apart.

6. The combination as recited in claim 4, wherein said rotary operator handle has a locking means for preventing rotation of said rotary operator handle and correspondingly the linear movement of said switch handle.

7. The combination as recited in claim 6, in which said remote rotary operator handle assembly further comprises a rotary handle operator casing in which said rotary operator handle assembly is disposed, and wherein said locking means comprises said rotary operator handle having an extendable hasp which is disposed upon said handle shaft, said hasp having an aperture for accepting a lock for preventing said hasp from withdrawing from said extended positions, said hasp further having a foot which becomes non-rotatably engaged with said casing when said hasp is in said extended position thereby preventing movement of said handle shaft.

8. The combination as recited in claim 4, further comprising a shaft support mechanism for assuring proper alignment of said housing shaft and for attaching one of said motion translators to said housing shaft, wherein said support mechanism comprises, a bracket attached to said housing, said bracket having disposed therein an aperture such that said aperture is aligned over said housing shaft, and a coupling telescoped over said housing shaft and extending through said aperture of said bracket wherein said one of said motion translators is mounted thereon.

9. The combination as recited in claim 1, wherein said linking means comprises a pair of bi-directional rotational to linear motion translators, said motion translators being fixedly attached one to each of said housing and handle shafts, and linearly movable connecting means attached between said motion translators for transferring between said motion translators the respective rotational movements.

10. The combination as recited in claim 9, wherein said linearly movable connecting means further has an adjusting means disposed between said motion translators for allowing said motion translators to be positioned at varying distances apart.

11. The combination as recited in claim 10, wherein said motion translators each comprise a sleeve mounted on each of said housing and handle shafts wherein each of said sleeves has axially extending therefrom a flange having rotatable connected thereto a rod.

12. The combination as recited in claim 11, wherein said connecting means comprises a pair of clamping devices each having a pair of parallel apertures extending therethrough, said apertures having perpendicularly intersecting lockscrews wherein said rods of said bi-directional motion translators are inserted into said apertures and secured into position with said lockscrews.

13. The combination as recited in claim 10, wherein said rotary operator handle has a locking means for preventing rotation of said housing shaft.

14. A remote rotary handle assembly adapted to be used with a circuit breaker having a linearly movable switch handle, said handle assembly comprising:

a housing assembly, adapted to be mounted on said circuit breaker, having a rotatable housing shaft, rotatable around a housing shaft axis, and further having a motion translating means connected to said housing shaft and adapted for engaging said switch handle for translating between the linear motion of said switch handle and the rotational motion of said housing shaft;

a rotary operator handle having a rotatable handle shaft, rotatable about a handle shaft axis, for cooperating with said switch handle whereby the movement of one produces a corresponding movement of the other and wherein said handle shaft axis is substantially parallelly aligned relative to said housing shaft axis; and linking means connecting said housing shaft to said handle shaft for transferring between said shafts said respective parallel rotational movements.

15. The assembly as recited in claim 14, wherein said linking means comprises a pair of bi-directional rotational to linear motion translators, said motion translators being fixedly attached one to each of said housing and handle shafts, and linearly movable connecting means attached between said motion translators for transferring between said motion translators the respective rotational movements.

16. The assembly as recited in claim 15, wherein said linearly movable connecting means further has an adjusting means disposed between said motion translators for allowing said motion translators to be positioned at varying distances apart.

17. The assembly as recited in claim 16, wherein said motion translators each comprise a sleeve mounted on each of said housing and handle shafts wherein each of said sleeves has axially extending therefrom a flange having rotatable connected thereto a rod.

18. The assembly as recited in claim 15, wherein said rotary operator handle has a locking means for preventing rotation of said housing shaft.

19. The assembly as recited in claim 18, further comprising a rotary handle operator casing in which said handle shaft is disposed wherein said locking means comprises a hasp having a foot wherein said foot is cooperable with said handle operator casing to prevent the rotation of the handle shaft.

* * * * *